US005495267A

United States Patent [19]

Fujitaka

[11] Patent Number: 5,495,267

[45] Date of Patent: Feb. 27, 1996

[54] DISPLAY CONTROL SYSTEM

[75] Inventor: Shigeaki Fujitaka, Hyogo, Japan

[73] Assignee: Mitsubishi Denki Kabushiki Kaisha, Tokyo, Japan

[21] Appl. No.: 286,595

[22] Filed: Aug. 5, 1994

Related U.S. Application Data

[63] Continuation of Ser. No. 3,151, Jan. 12, 1993, abandoned.

[30] Foreign Application Priority Data

Oct. 16, 1992 [JP] Japan ..... 4-025742

[51] Int. Cl.[6] ..... G09G 5/34

[52] U.S. Cl. ..... 345/123; 345/124

[58] Field of Search ..... 345/25, 123, 124, 345/141, 144; 395/148, 150

[56] References Cited

U.S. PATENT DOCUMENTS

| | | | |
|---|---|---|---|
| 4,663,615 | 5/1987 | Hernadez et al. | 340/724 |
| 4,766,427 | 8/1988 | Abe et al. | 340/724 |
| 4,803,478 | 2/1989 | Olsen | 340/724 |
| 4,873,514 | 10/1989 | Nakagawa et al. | 345/124 |
| 4,962,475 | 10/1990 | Hernadez et al. | 364/900 |
| 5,038,138 | 8/1991 | Akiyama et al. | 340/724 |
| 5,150,107 | 9/1992 | Kurisu | 340/724 |
| 5,175,813 | 12/1992 | Golding et al. | 345/123 |

FOREIGN PATENT DOCUMENTS

| | | | |
|---|---|---|---|
| 54-105435 | 8/1979 | Japan | 395/144 |
| 91/07739 | 5/1991 | WIPO | 345/124 |

*Primary Examiner*—Ulysses Weldon
*Assistant Examiner*—Amare Mengistu
*Attorney, Agent, or Firm*—Townsend and Townsend and Crew

[57] ABSTRACT

In a control system for a screen display for displaying characters or patterns on a display by reading font data from storage means for storing font data for characters, symbols and the like according to outside data, and capable of scrolling these display contents over a scroll section having a fixed width in both vertical and horizontal directions, to display the display contents in such a way that they appear or disappear from a predetermined position, output to the display is inhibited in a predetermined section on one side of the scroll section by an display control data output inhibition circuit.

2 Claims, 17 Drawing Sheets

DISPLAY CONTROL SYSTEM

This is a continuation of application Ser. No. 08/003,151, filed Jan. 12, 1993, now abandoned.

BACKGROUND OF THE INVENTION

1. Field of the Invention

The present invention relates to a screen display for displaying characters and the like on a predetermined range of the screen of a display such as a CRT and a liquid crystal display, and more particularly, to a control system for a screen display which enables vertical or horizontal scroll display of display contents from one side of the screen to the other.

2. Description of the Prior Art

Conventionally, images received by commercial radio waves are displayed on the screen of a CRT, and characters and patterns indicating channel number and various operation conditions are displayed over the received images. FIG. 14 is a block diagram of the conventional screen display. Reference numeral 1 represents a read address control circuit, 5 a synchronizing signal input circuit, 6 an oscillator circuit, 7 an H counter, 8 a timing generator, 9 a display position detection circuit, 10 an input control circuit, 11 an address control circuit, 12 a display control register, 13 a display data RAM, 14 a data control circuit, 15 a character ROM, 16 a synthesizer circuit, 17 a shift register and 18 a display control circuit.

The operation of the display will be described hereafter.

When the synchronizing signal input circuit 5 receives a horizontal synchronizing signal HSYNC and a vertical synchronizing signal VSYNC, it inputs synchronizing signals based on these synchronizing signals into the oscillator circuit 6 and the H counter 7. The oscillator circuit 6 inputs a predetermined oscillation output based on the input synchronizing signal into the timing generator 8, which generates a timing signal required for the operation of each part based on the oscillation output for output to each part. The H counter 7 is reset by each vertical synchronizing signal and counts the horizontal synchronizing signal. A count value of the H counter is provided to the display position detection circuit 9 for detecting the display position of characters and patterns. The display position detection circuit 9 detects an image display position on the screen which is set in advance according to the input synchronizing signals and adjusts timing to display the received image.

Meanwhile, an image data CD provided from an unshown microcomputer for displaying an image is inputted into the input control circuit 10. The address control circuit 11 specifies addresses in the display control register 12 and the display data RAM 13 according to an input address. The display control register 12 and the display data RAM 13 have different addresses on the same address space, whereby the above-mentioned input data is written onto the specified addresses in the display control register 12 and the display data RAM 13 through the data control circuit 14. The data include character code, color information, display mode and display position data.

The display position detection circuit 9 compares display position data stored in the display control register 12 and a count value of the H counter 7. When they coincide, the circuit provides a coincidence signal to the read address control circuit 1. The read address control circuit 1 is thereby activated to start reading the written data by specifying an address in the display data RAM 13. The display data RAM 13 provides an address for a written character code to the character ROM 15, by which a character font corresponding to the code is read from the character ROM 15.

A single font consists of l×m-dot pixels, for example, as shown in FIG. 15. Therefore, the character ROM 11 has a memory capacity of l×m×n dots for storing fonts for n characters. Font data read from the character ROM 15 are produced by the synthesizer circuit 16 when necessary. The output data of the synthesizer circuit 16 are converted from parallel format to serial format by the shift register 17 and provided to the display control circuit 18. The display control circuit 18 receives color information data including color and background color from the display data RAM 13 and display mode data indicating the ornamentation of characters from the display control register 12 in addition to font data from the shift register 17 for display control of the font data and color information data according to a display mode specified by the display mode data. Thus, red, green and blue output signals and a luminance control signal are generated from the display control circuit 18, and desired characters and patterns are displayed on the screen according to these signals.

Every dot of font dot data in vertical direction is stored in the address area of the character ROM 15 in which the font dot data are produced by decoding character code data representing each font. In the case of FIG. 15, vertical one-dot font data is stored in each line having an address which is called AD1, AD2 . . ., AD1-1, and AD1 from the top. These dot data are outputted from the character ROM 15 from the top. The read address control circuit 1 counts from one to l for the vertical lines of a single character, and specifies an address in the display data RAM 13 when it completes the display of an l-th line. Thereafter, the dot data of the character ROM 15 corresponding to a character code is outputted one after another from the display data RAM 13.

Vertical scroll display using the above-mentioned screen display will be described hereafter. Vertical scroll display means that display contents move from the bottom (or the top) to the top (or the bottom) of the screen.

Each time an interrupt is generated for each vertical synchronizing signal (VSYNC), the vertical position data of the display control register 12 is rewritten by the unshown microcomputer. At this time, when the display position data is decremented for each vertical synchronizing signal, displayed characters look as if they are scrolled from the bottom to the top of the screen (refer to FIG. 16). When the display position data is incremented for each vertical synchronizing signal, displayed characters look as if they are scrolled from the top to the bottom of the screen (unshown). In this way, as shown in FIG. 16, the screen S of a display such as a CRT or a liquid crystal display is scanned by a scanning line F from the top Sa to the bottom Sb to display display contents N such as characters and figures on the screen S according to the output of the screen display while displaying an image received by commercial radio waves. The display contents N can be scrolled from the bottom to the top of the screen or vice versa over a scroll section P having a predetermined width. In other words, the display contents N in the scroll section P are formed by scanning the scanning line F from the display start position Pa, the top side of the scroll section P on the opposite side of a scroll direction, to the display end position Pb, the bottom side of the scroll section P.

Display contents can be scrolled from left to right, or vice versa by setting the scroll section P in the horizontal direction of the screen.

Since the conventional screen display is structured as described above, vertical scroll display is such as shown in FIG. 16. Therefore, to display "C" below the line for "B", the entire font for "C" is always displayed, and natural scroll display in which a character font on the lowest line is displayed little by little from a predetermined position Pt as shown in FIG. 17 is impossible. The same can be said of scroll display from the top to the bottom of the screen.

SUMMARY OF THE INVENTION

The present invention is intended to solve the above problem, and it is an object of the invention to provide a screen display capable of scroll display in which display contents are displayed from a predetermined position Pt little by little.

Therefore, in a first embodiment of the present invention, output to the display is inhibited in predetermined sections Pm, Pn, Pf and Pj on sides Pb, Pa, Pd and Pe of the scroll section P by an display control data output inhibition circuit 22.

In a second embodiment of the present invention either one of the inhibition start operation and inhibition release operation of the display control data output inhibition circuit 22 is performed according to data for predetermined positions Pt, Ph, Pg and Pi set in the register in advance, and the other operation is performed according to data for the sides Pb, Pa, Pd and Pe of the scroll section P.

In a third embodiment of the present invention claimed in the case of scroll from the bottom to the top of the screen or from the right to the left of the screen, on one side of the scroll section P opposite to a scroll direction, the inhibition operation of the output signal inhibition circuit 22 is released according to data generated from the screen display, and performed according to data for a predetermined position away from the above-mentioned side toward the center of the screen, while in the case of scroll from the top to the bottom of the screen or from the left to the right of the screen, on one side of the scroll section P opposite to a scroll direction, the inhibition operation of the display control data output inhibition circuit 22 is performed according to data generated from the screen display and released according to data for a predetermined position away from the above-mentioned side toward the center of the screen so that an output inhibition section is provided on one side of the scroll section P opposite to a scroll direction.

In a fourth embodiment of the present invention the output signal inhibition circuit and two registers are provided on the output side of the screen display, and the inhibition start and release operations of the display control data output inhibition circuit 22 are performed according to data for predetermined positions Pt and Ph set in each register in advance so that output to the above-mentioned display is inhibited in predetermined sections Pm and Pn on both sides of the scroll section P of the display by the display control data inhibition circuit 22.

That is, according to the first embodiment of the present invention, since output to the display is inhibited by the display control data inhibition circuit 22 when characters or patterns are to be displayed in the predetermined sections Pm, Pn, Pf and Pj on the sides Pb, Pa, Pd and Pe of the scroll section P, they are not displayed in these sections Pm, Pn, Pf and Pj.

According to second embodiment of the present invention, either one of the inhibition start and release operations of the display control data output inhibition circuit 22 is performed according to data for predetermined positions Pt, Ph, Pg and Pi set in the register in advance, and the other operation is performed according to data for the sides Pb, Pa, Pd and Pe of the scroll section P.

According to the third embodiment of the present invention, in the case of scroll from the bottom to the top of the screen or from the right to the left of the screen, on one side of the scroll section P opposite to a scroll direction, the inhibition operation of the display control data output inhibition circuit 22 is released according to data generated from the screen display, and performed according to data for a predetermined position away from the above-mentioned side toward the center of the screen. In the case of scroll from the top to the bottom of the screen or from the left to the right of the screen, on one side of the scroll section P opposite to a scroll direction, the inhibition operation of the display control data output inhibition circuit 22 is performed according to data generated from the screen display and released according to data for a predetermined position away from the above-mentioned side toward the center of the screen.

According to the fourth embodiment of the present invention since the inhibition start and release operations of the display control data output inhibition circuit 22 are performed according to data for predetermined positions Pt and Ph set in each register in advance, output to the screen display is inhibited in predetermined sections Pm and Pn on both sides of the scroll section P by the display control data output inhibition circuit 22.

The above and other objects, features and advantages of the invention will become more apparent from the following description when taken in conjunction with the accompanying drawings.

DESCRIPTION OF THE PREFERRED EMBODIMENT

Embodiment 1

Figure 1:
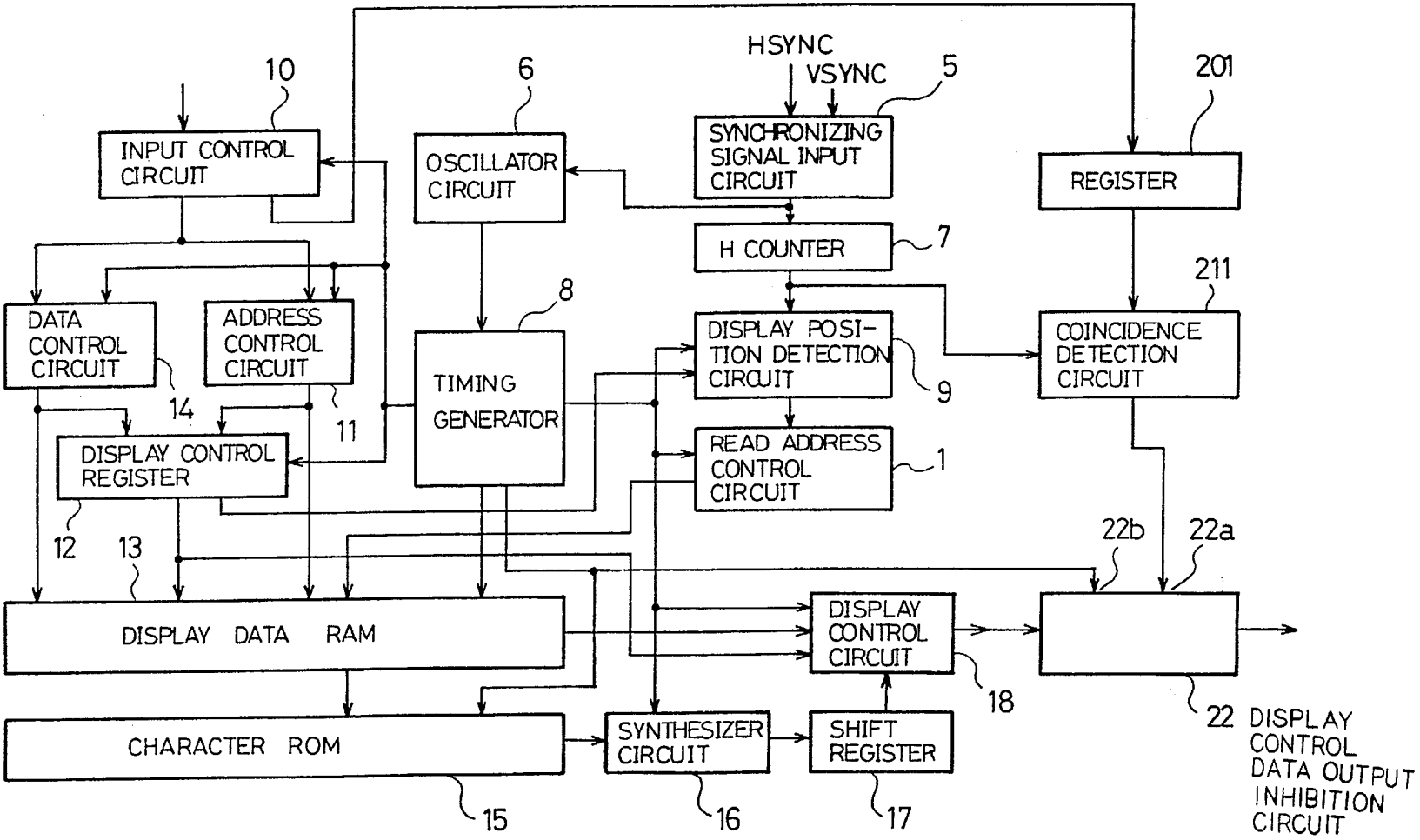
FIG. 1 is a block diagram of an embodiment of the invention.
Figure 2:
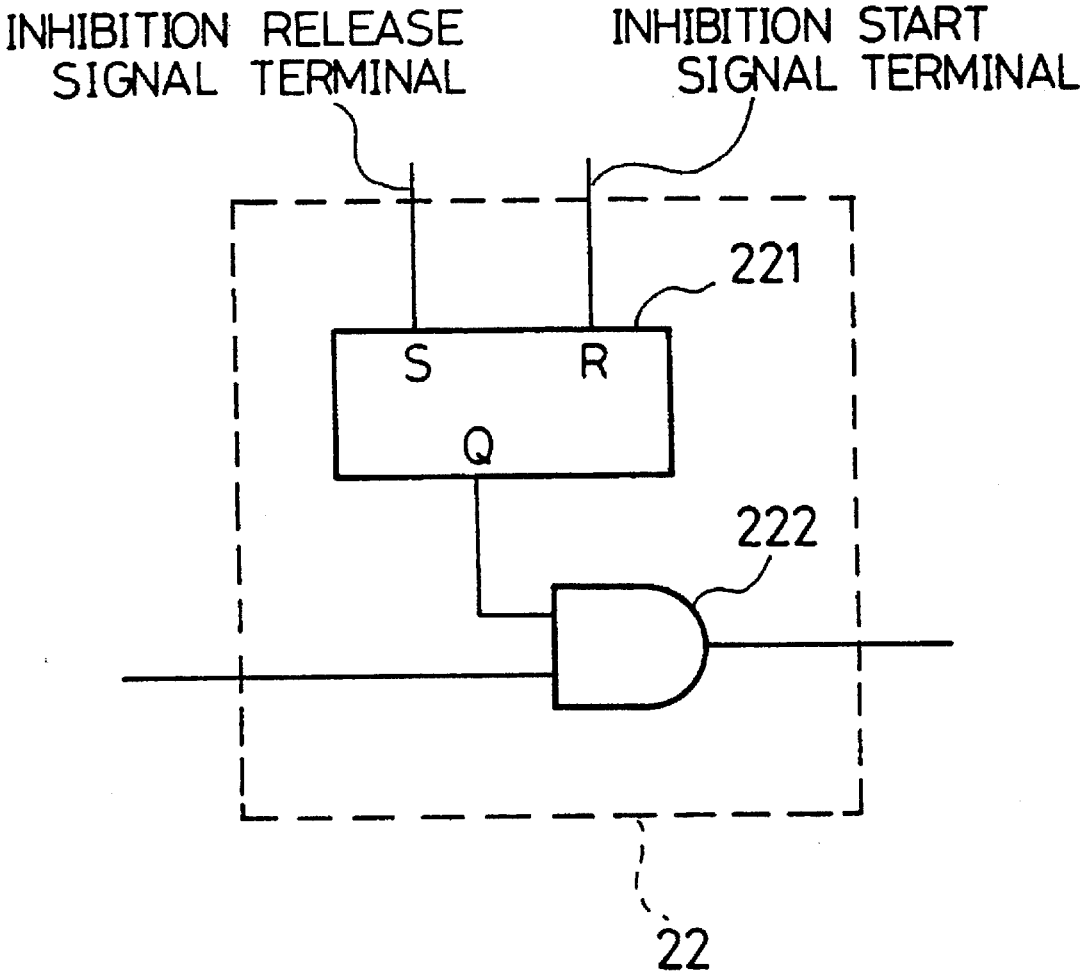
FIG. 2 is a block diagram of the output signal inhibition circuit shown in FIG. 1.

FIG. 1 is a system block diagram of an embodiment of the present invention. Reference numeral 1 represents a read address control circuit, 5 a synchronizing signal input circuit, 6 an oscillator circuit, 7 an H counter, 8 a timing generator, 9 a display position detection circuit, 10 an input control circuit, 11 an address control circuit, 12 a display control register, 13 a display data RAM, 14 a data control circuit, 15 a character ROM, 16 a synthesizer circuit, 17 a shift register and 18 a display control circuit. These elements are the same as in the prior art. Reference numeral 201 represents a register for storing data indicating the inhibition of display at a predetermined position Pt, 211 a coincidence detection circuit for detecting coincidence between the data of the H counter 7 and the data of the register 201, 22 an display control data output inhibition circuit whose inhibition start signal terminal 22*a* (set terminal) is linked to the output of the coincidence detection circuit 211 and whose inhibition release signal terminal 22*b* (reset terminal) is linked to the display end data (data for a lower side Pb which is a display end position) of the timing generator 8. These are the key elements of the present invention. FIG. 2 is a block diagram of the internal configuration of the output signal inhibition circuit 22 of the embodiment. In the figure, reference numeral 221 represents a set-reset flip-flop whose reset terminal is connected to the inhibition start signal terminal 22*a* and whose set terminal is connected to the inhibition release signal terminal 22*b*, and 222 an AND circuit one of whose input terminals is connected to the output of the set-reset flip-flop 221 and the other input terminal is connected to the output of the display control circuit 18. The output of the AND circuit 222 is the output of the display control data output inhibition circuit 22, and the lower side Pb is the side opposite to the scroll direction.

The operation of the screen display structured as described above will be described hereafter.

When the synchronizing signal input circuit 5 receives a horizontal synchronizing signal HSYNC and a vertical synchronizing signal VSYNC, it inputs synchronizing signals based on these synchronizing signals into the oscillator circuit 6 and the H counter 7. The oscillator circuit 6 inputs a predetermined oscillation output based on the input synchronizing signal into the timing generator 8, which generates a timing signal required for the operation of each part based on the oscillation output for output to each part. The H counter 7 is reset by each vertical synchronizing signal and counts the horizontal synchronizing signal. A count value of the H counter is provided to the display position detection circuit 9 for detecting the display position of characters and patterns. The display position detection circuit 9 detects an image display position on the screen which is set in advance according to the input synchronizing signals and adjusts timing to display the received image.

Meanwhile, an image data CD provided from an unshown microcomputer for displaying an image is inputted into the input control circuit 10. The address control circuit 11 specifies addresses in the display control register 12 and the display data RAM 13 according to an input address. The display control register 12 and the display data RAM 13 have different addresses on the same address space, whereby the above-mentioned input data is written onto the specified addresses in the display control register 12 and the display data RAM 13 through the data control circuit 14. The data include character code, color information, display mode and display position data.

The display position detection circuit 9 compares display position data stored in the display control register 12 and a count value of the H counter 7. When they coincide, the circuit provides a coincidence signal to the read address control circuit 1. The read address control circuit 1 is thereby activated to start reading the written data by specifying an address in the display data RAM 13. The display data RAM 13 provides an address for a written character code to the character ROM 15, by which a character font corresponding to the code is read from the character ROM 15.

Figure 15:
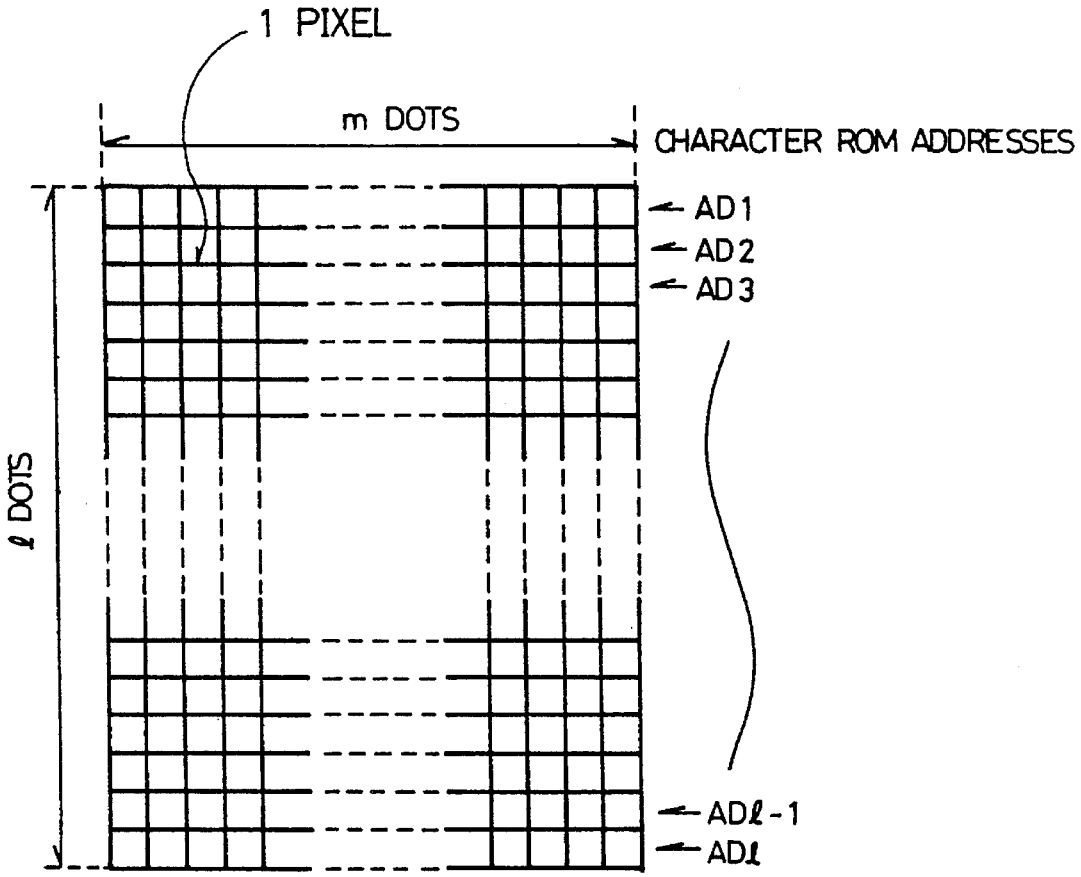
FIG. 15 PRIOR ART
FIG. 15 is a diagram of the configuration of a memory area of the character ROM.
Figure 16:
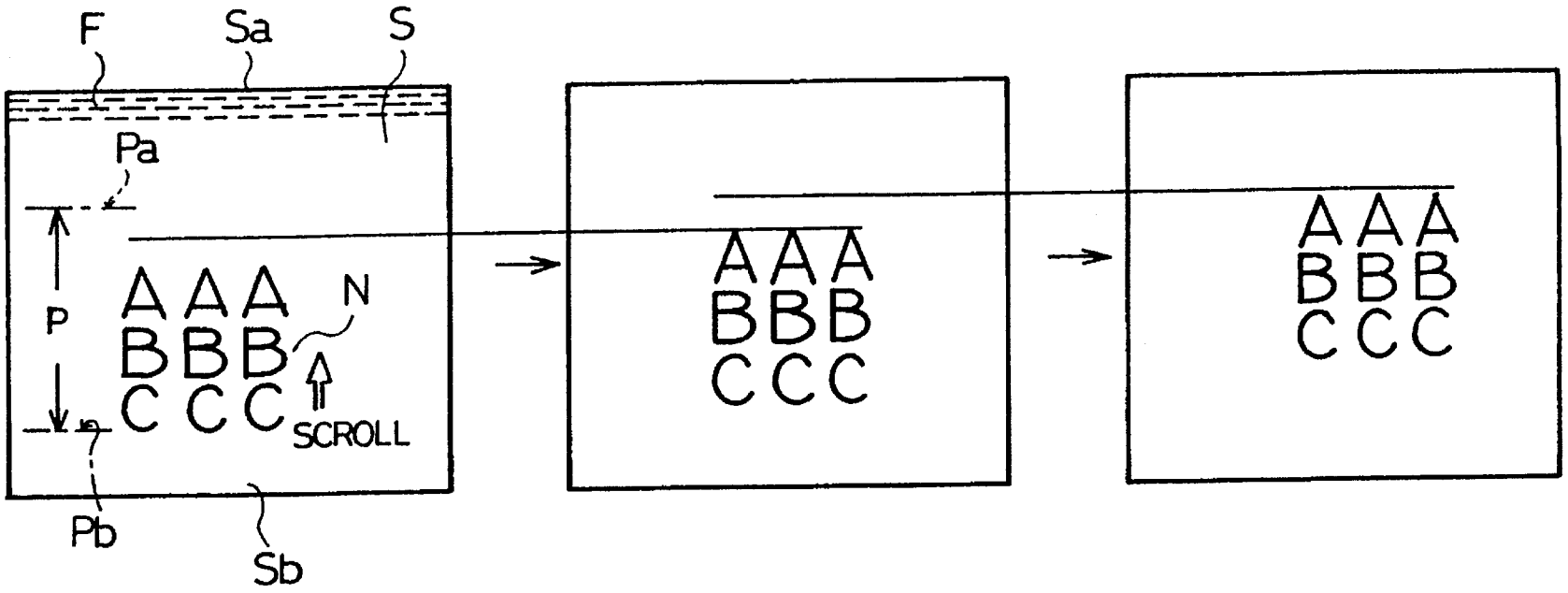
FIG. 16 PRIOR ART
FIG. 16 is a diagram of an example of the vertical scroll display of the prior art.

A single font consists of l×m-dot pixels, for example, as shown in FIG. 15. Therefore, the character ROM 11 has a memory capacity of l×m×n dots for storing fonts for n characters. Font data read from the character ROM 15 are produced by the synthesizer circuit 16 when necessary. The output data of the synthesizer circuit 16 are converted from parallel format to serial format by the shift register 17 and provided to the display control circuit 18. The display control circuit 18 receives color information data including color and background color from the display data RAM 13 and display mode data indicating the ornamentation of characters from the display control register 12 in addition to font data from the shift register 17 for display control of the font data and color information data according to a display mode specified by the display mode data. Thus, red, green and blue output signals and a luminance control signal are generated from the display control circuit 18.

Figure 3:
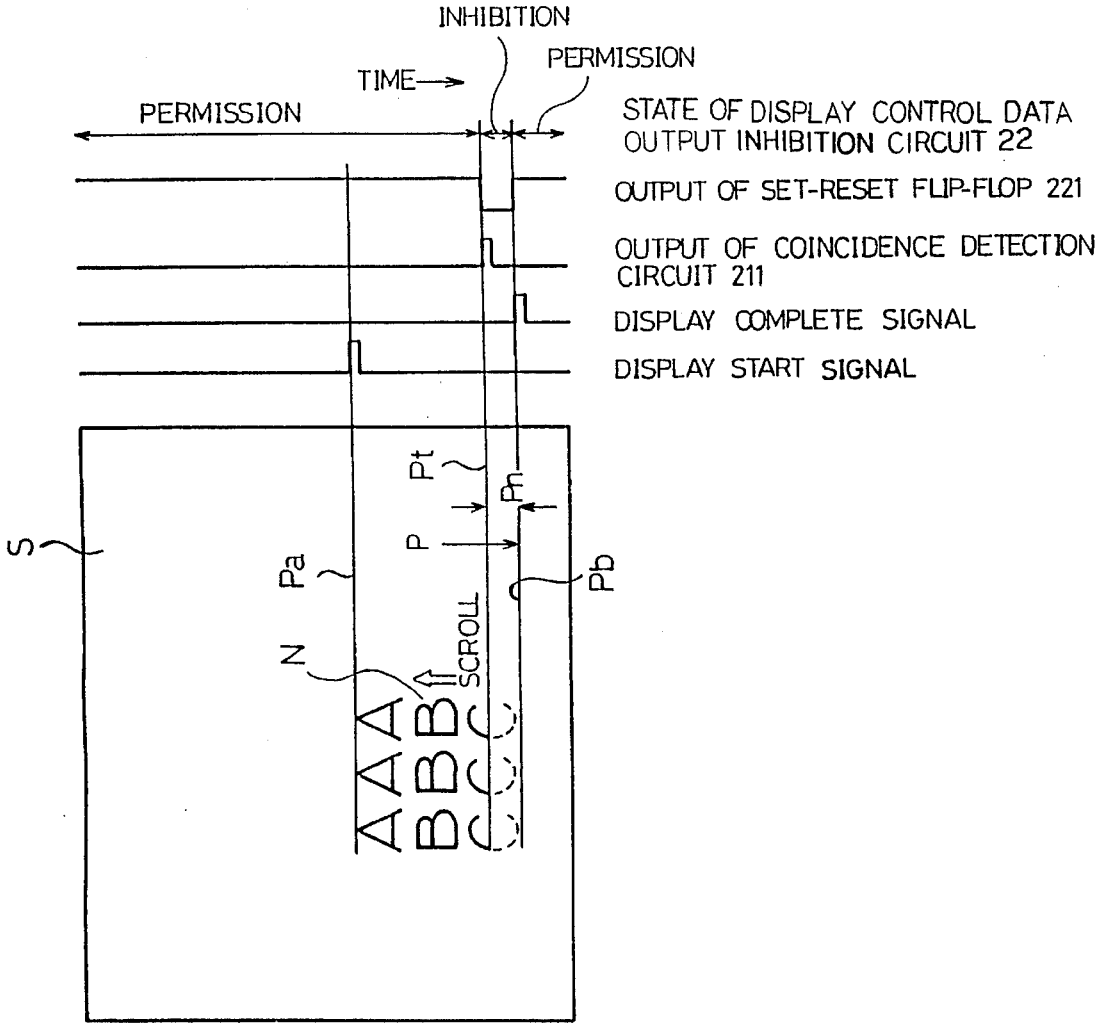
FIG. 3 is a timing chart illustrating the operation of the embodiment of FIG. 1.

As described above, the process of generating the red, green and blue output signals and the luminance control signal from the display control circuit 18 is the same as the prior art. Display inhibition start data (for a predetermined position Pt) is stored in the register 201 through the input control circuit 10. This operation is the same as the data input of the display control register 12. The H counter 7 is reset by each vertical synchronizing signal and counts the horizontal synchronizing signal. The coincidence detection circuit 211 compares the display inhibition start data stored in the register 201 and a count value of the H counter 7. When they coincide, the coincidence detection circuit 211 outputs a coincidence signal to the inhibition start signal terminal 22*a* of the display control data output inhibition circuit 22. Thereby, the set-reset flip-flop 221 in the output signal inhibition circuit 22 outputs "L", whereby the output of the AND circuit 222 is fixed at "L", thus inhibiting the output of the red, green and blue output signals and the luminance control signal from the display control circuit 18. Therefore, a lower part of a font "C" is not displayed in FIG. 3 as coincidence is detected during the display of "C" on the lowest line. Thereafter, when display inhibition release data (display end data) generated on a lower side Pb by scanning for displaying contents N is outputted by the timing generator 8, the set-reset flip-flop 221 outputs "H", whereby the AND circuit 222 permits the output of the circuit 18. In this way, output to the display such as a CRT is inhibited in the lower section Pn of the scroll section P, which is the display range of the display contents N based on the output of the screen display, by the display control data output inhibition circuit 22, whereby the display contents are not displayed in the predetermined section Pn, and they look as if the lower part of characters of the display contents N come up from the predetermined position Pt set in the register 201 in advance.

Therefore, vertical scroll display can be performed with the screen display of this embodiment in the following way.

Figure 17:
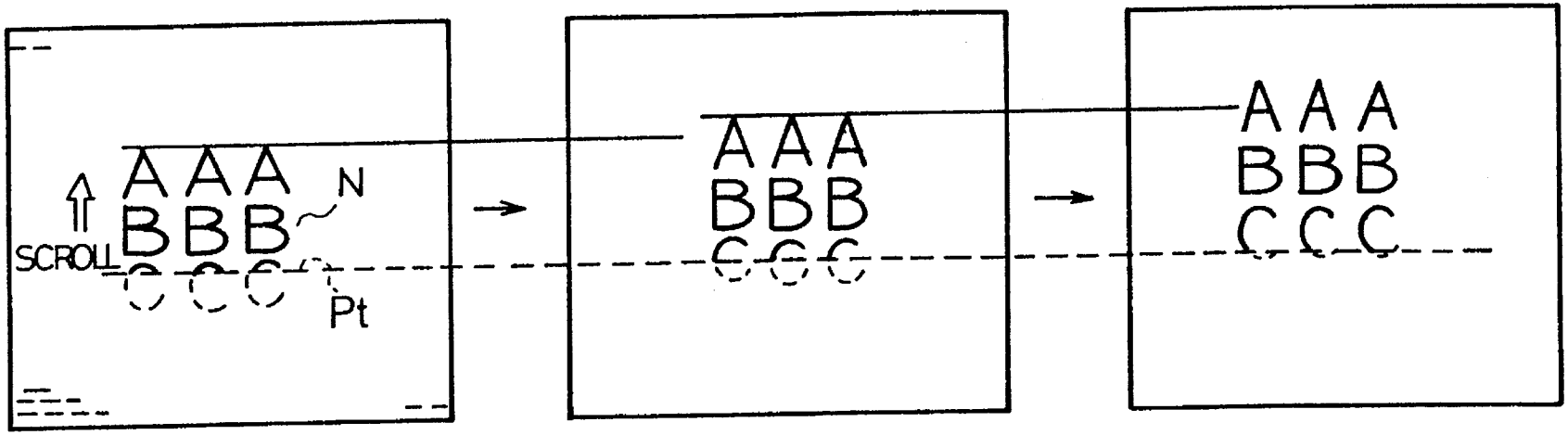
FIG. 17 is a diagram of an example of the vertical scroll display of the embodiment of FIG. 1.

At the time when image data CD for displaying an image is set, display inhibition data is set in the register 201. Each time an interrupt is generated for each vertical synchronizing signal, the vertical position data of the display control register 12 is replaced with decremented data by the unshown microcomputer. At this time, as described previously, since the display control data output inhibition circuit 22 inhibits the output of red, green and blue output signals and the luminance control signal at positions below the predetermined position set in the register 201, displayed characters look as if they are scrolled from the bottom to the top of the screen, and character fonts on the lowest line come to appear little by little (refer to FIG. 17).

In this way, natural upward scroll is possible.

Embodiment 2

In the above-mentioned Embodiment 1, the inhibition start signal terminal **22*a* is linked to the output of the coincidence detection circuit 211, and the inhibition release signal terminal 22*b* is linked to the display end data of the timing generator 8. However, in this embodiment, the inhibition release signal terminal 22*b* is linked to the output of the coincidence detection circuit 212, and the inhibition start signal terminal 22*a* is linked to the display start data of the timing generator 8** so that natural downward scroll is possible.

Figure 4:
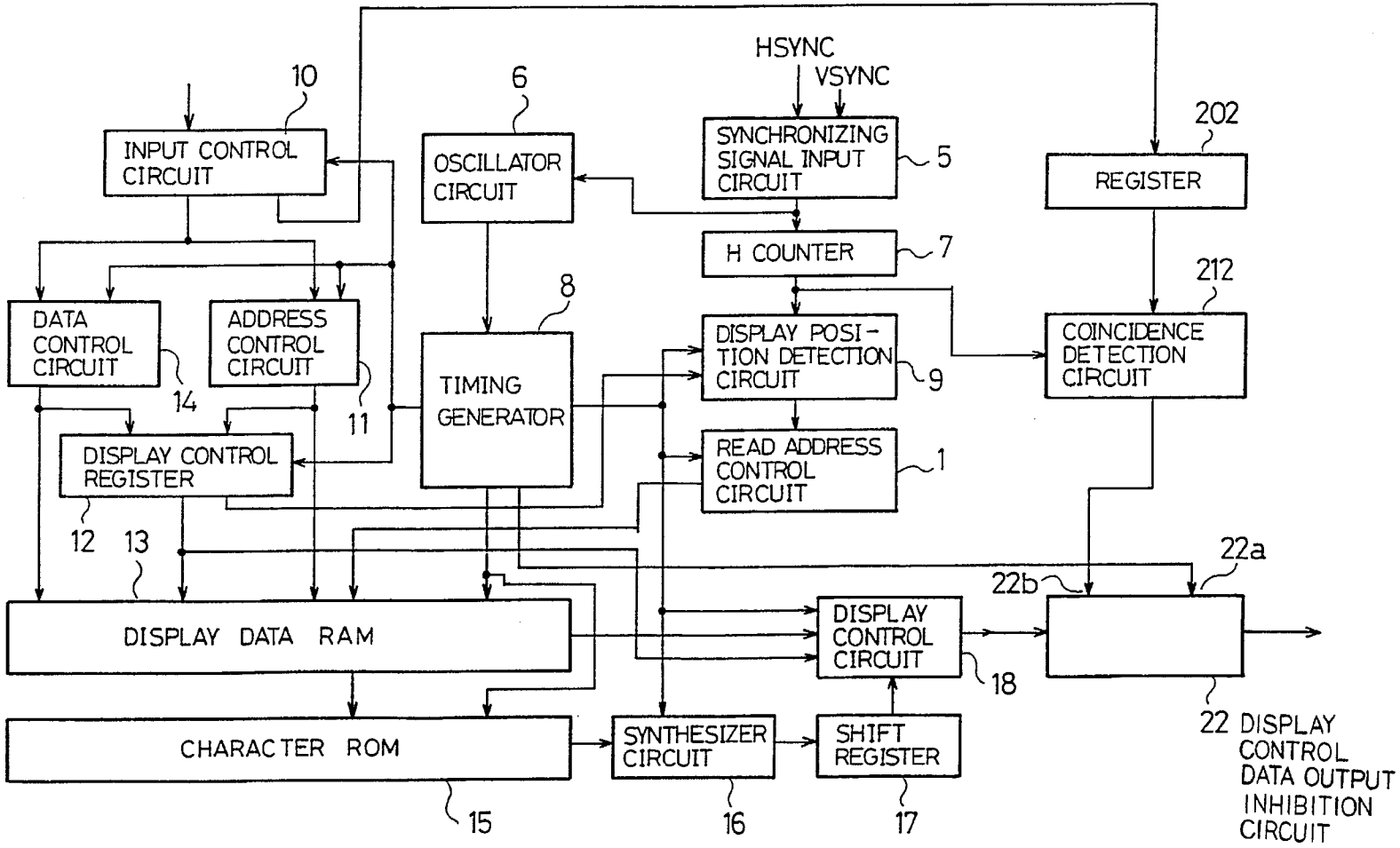
FIG. 4 is a block diagram of another embodiment of the invention.

FIG. 4 is a system block diagram of this embodiment of the present invention.

Reference numeral 1 represents a read address control circuit, 5 a synchronizing signal input circuit, 6 an oscillator circuit, 7 an H counter, 8 a timing generator, 9 a display position detection circuit, 10 an input control circuit, 11 an address control circuit, 12 a display control register, 13 a display data RAM, 14 a data control circuit, 15 a character ROM, 16 a synthesizer circuit, 17 a shift register, and 18 a display control circuit. These elements are the same as the prior art. Reference numeral 202 represents a register for storing display inhibition release data for a predetermined position Ph, 212 a coincidence detection circuit for detecting coincidence between the data of the H counter 7 and the data of the register 202, 22 an display control data output inhibition circuit whose inhibition release signal terminal **22*b* is connected to the output of the coincidence detection circuit 212, and whose inhibition start signal terminal 22*a* is linked to the display start data of the timing generator 8. These are the key elements of the present invention. A block diagram of the internal configuration of the output signal inhibition circuit 22 of this embodiment is the same as Embodiment 1 of FIG. 2**. Here, an upper side Pa of the scroll section P is the side opposite to the scroll direction.

Figure 5:
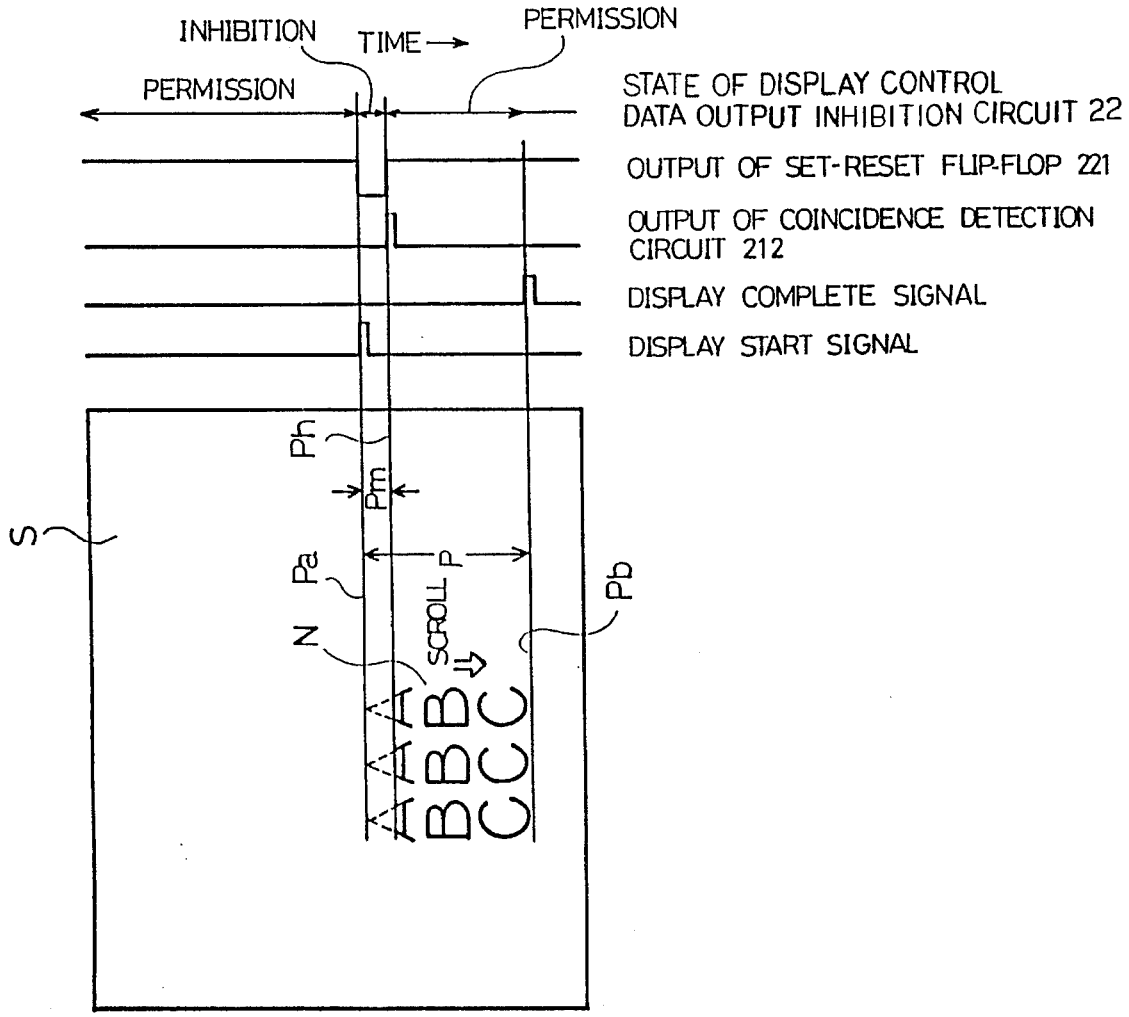
FIG. 5 is a timing chart illustrating the operation of the embodiment of FIG. 4.

The operation of the embodiment will be described hereafter. The process of generating red, green and blue output signals and the luminance control signal from the display control circuit 18 is the same as in Embodiment 1. Next, the operation of the display control data output inhibition circuit 22 will be described with reference to FIG. 5. The display inhibition release data is stored in the register 202 through the input control circuit 10. This operation is the same as the data input of the display control register 12. The H counter 7 is reset by each vertical synchronizing signal and counts the horizontal synchronizing signal. When a position to start display is reached, the timing generator 8 outputs the display start data to be generated on the upper side Pa. That is, the set-reset flip-flop 221 in the display control data output inhibition circuit 22 outputs "L" according to the display start data generated on the upper side Pa, which is a display start position, by scanning for displaying contents N, and the output of the AND circuit 222 is fixed at "L", whereby the output of the red, green and blue output signals and the luminance control signal from the display control circuit 18 is inhibited. Therefore, a part of a character font "A" on the top line is not displayed as shown in FIG. 5. Thereafter, the H counter counts the horizontal synchronizing signal, and the coincidence detection circuit 212 compares display inhibition release data for the predetermined position Ph stored in the register 202 and a count value of the H counter 7. When they coincide, the coincidence detection circuit 212 outputs a coincidence signal to the inhibition release signal terminal **22*b* of the display control data output inhibition circuit 22. The set-reset flip-flop 221 in the output signal inhibition circuit 22 thereby outputs "H", and accordingly, the AND circuit 222 permits the output of the display control circuit 18. In FIG. 5, since coincidence is detected during the display of a character font "A" on the top line, fonts after that are displayed. In this way, in the upper section Pm of the scroll section P which is the display range of the display contents N, output to the display is inhibited by the display control data output inhibition circuit 22, whereby the display contents N are not displayed in this predetermined section Pm, and they look as if an upper part of the characters of the display contents N comes out from the predetermined position Ph set in the register 202** in advance.

Therefore, vertical scroll display can be performed with the display of this embodiment of the invention in the following way.

Figure 6:
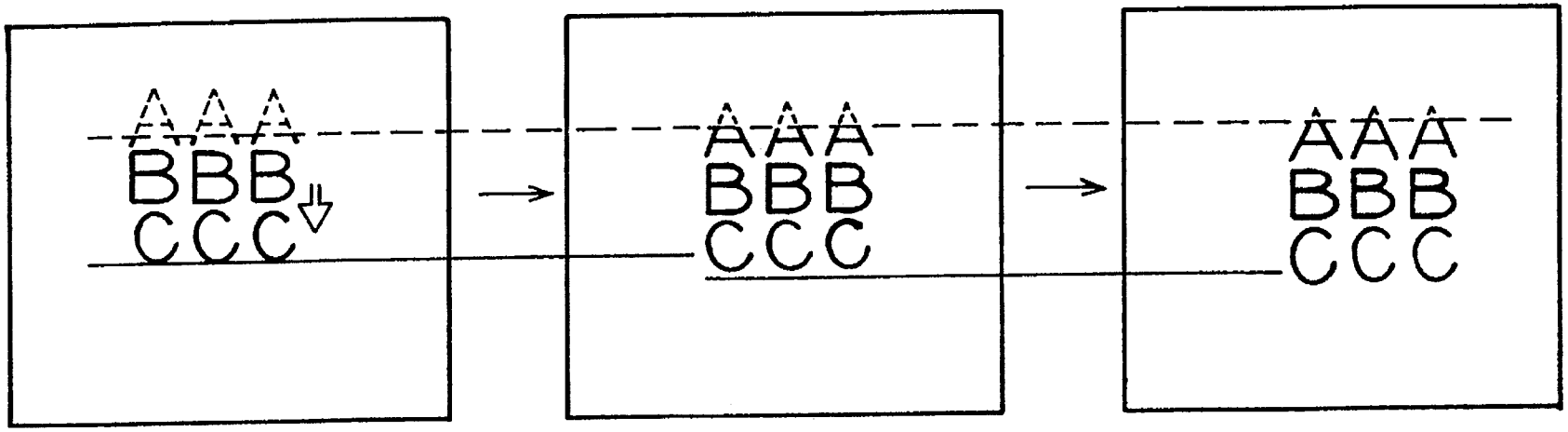
FIG. 6 is a diagram of an example of the vertical scroll display of the embodiment of FIG. 4.

At the time when image data CD for displaying an image is set, display inhibition release data for the predetermined position Ph is set in the register 202. Each time an interrupt is generated for each vertical synchronizing signal (VSYNC), the vertical position data of the display control register 12 is replaced with incremented data by the unshown separate microcomputer. At this time, as described previously, since the display control data output inhibition circuit 22 inhibits the output of the red, green and blue output signals and the luminance control signal at positions above the predetermined position Ph set in the register 202, displayed characters look as if they are scrolled from the top to the bottom of the screen, and character fonts on the top line come to appear little by little (refer to FIG. 6).

In this way, natural downward scroll is possible.

Embodiment 3

In the above Embodiments 1 and 2, a pair of a register for storing data indicating display inhibition or display start and a coincidence detection circuit for outputting a coincidence detection signal are provided. The same operation can be achieved by providing two pairs of the registers and the coincidence detection circuits to the screen display.

Figure 7:
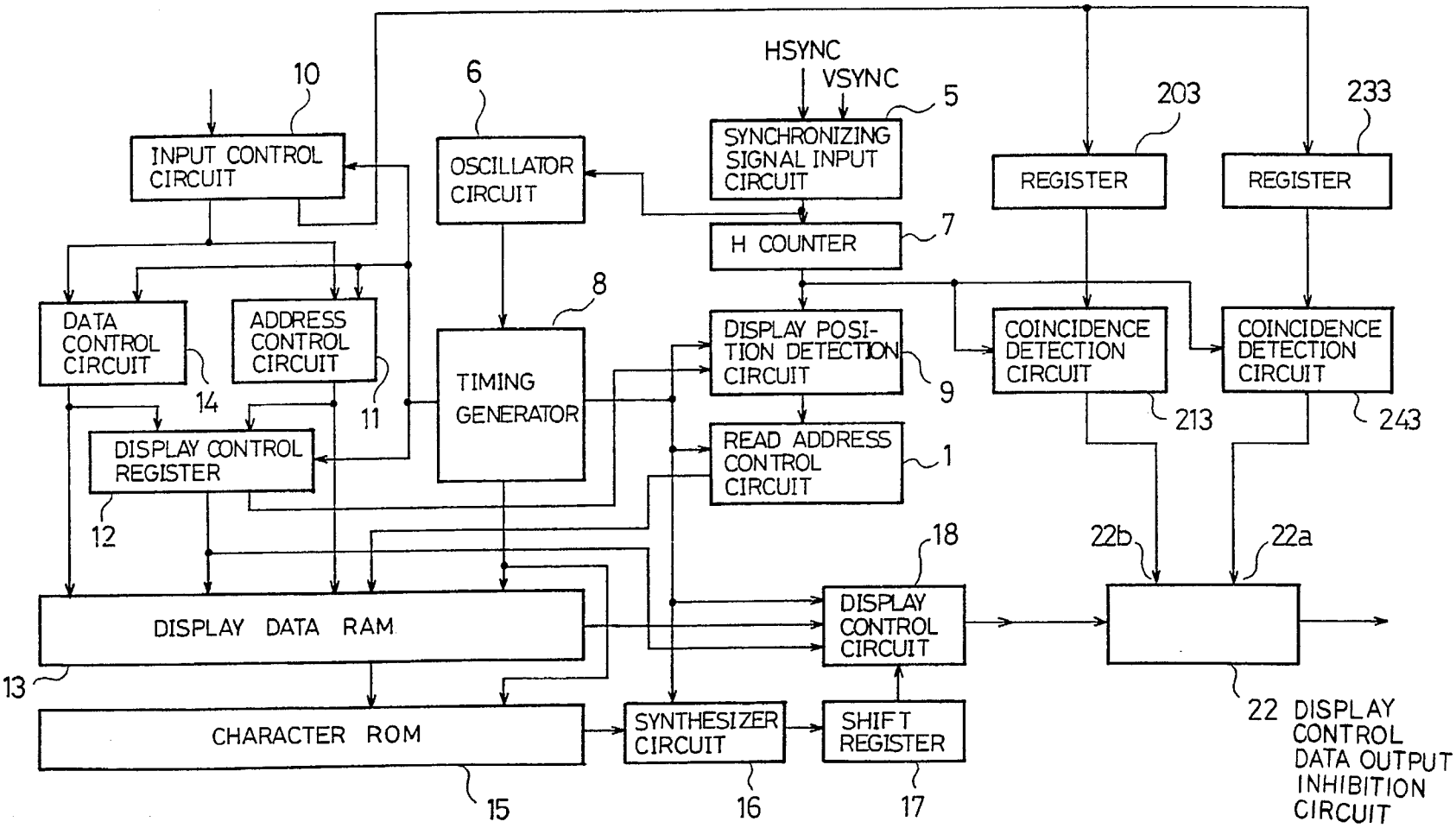
FIG. 7 is a block diagram of another embodiment of the invention.

FIG. 7 is a system block diagram of this embodiment of the present invention.

Reference numeral 1 represents a read address control circuit, 5 a synchronizing signal input circuit, 6 an oscillator circuit, 7 an H counter, 8 a timing generator, 9 a display position detection circuit, 10 an input control circuit, 11 an address control circuit, 12 a display control register, 13 a display data RAM, 14 a data control circuit, 15 a character ROM, 16 a synthesizer circuit, 17 a shift register, and 18 a display control circuit. These elements are the same as the prior art. Reference numeral 203 represents a first register for storing display inhibition release data for a predetermined position Ph which is slightly below the upper side Pa, 213 a first coincidence detection circuit for detecting coincidence between a count value of the H counter 7 and the data of the register 201, 233 a second register for storing display inhibition start data for a predetermined position Pt which is slightly above the lower side Pb, 243 a second coincidence detection circuit for detecting coincidence between a count value of the H counter 7 and the data of the second register 233, and 22 an display control data output inhibition circuit whose inhibition release signal terminal 22*b* is connected to the output of the first coincidence detection circuit 213, and whose inhibition start signal terminal 22*a* is linked to the output of the second coincidence detection circuit 243. These are the key elements of the present invention. A block diagram of the internal configuration of the display control data output inhibition circuit 22 of this embodiment is the same as Embodiment 1 of FIG. 2.

Figure 8:
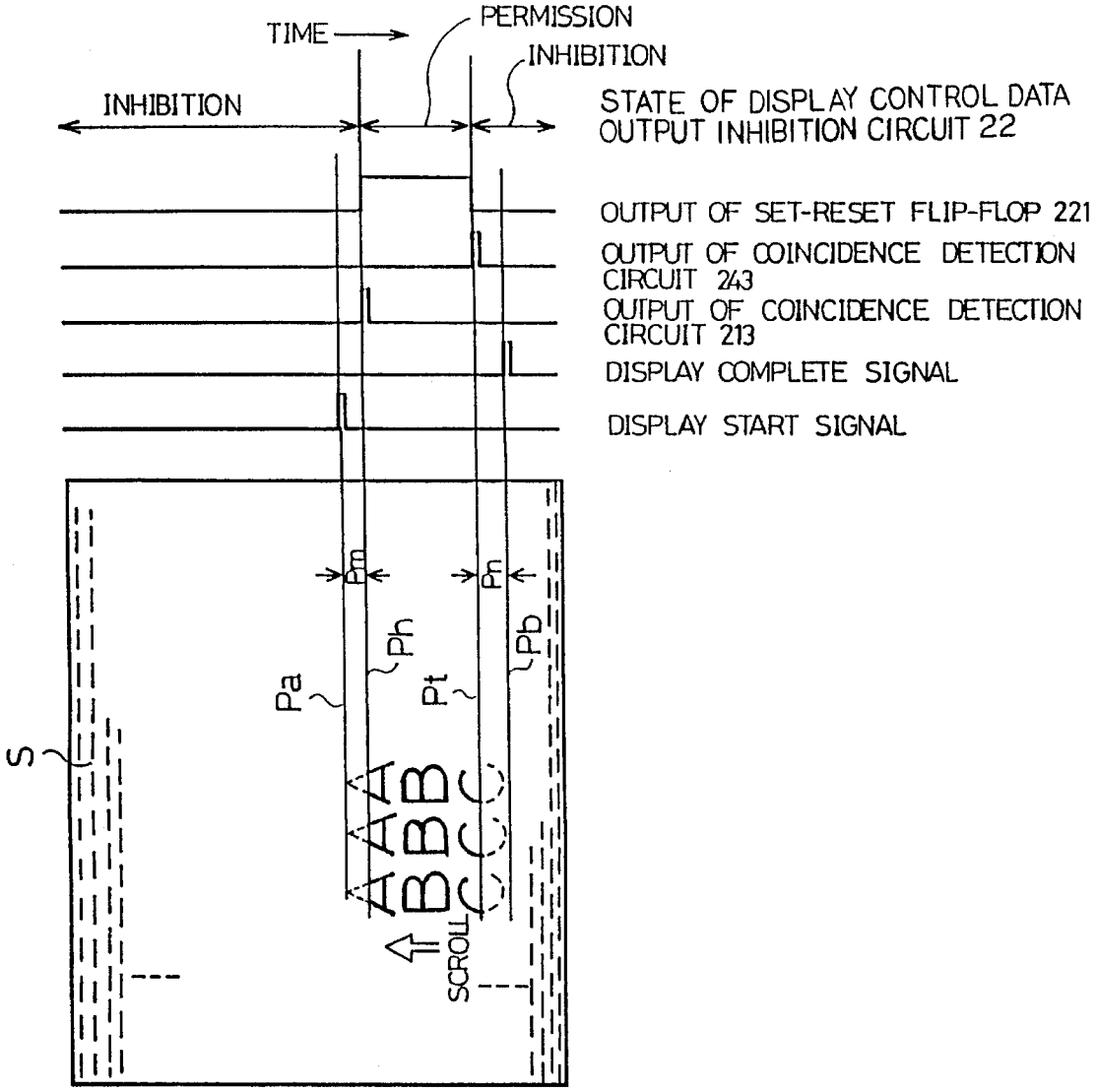
FIG. 8 is a timing chart illustrating the operation of the embodiment of FIG. 7.

The operation of this embodiment will be described hereafter. The process of generating the red, green and blue output signals and the luminance control signal from the display control circuit 18 is the same as Embodiment 1. Next, the operation of the output signal inhibition circuit 22 will be described with reference to FIG. 8. Display inhibition start data for a predetermined position Pt and display inhibition release data for a predetermined position Ph are stored in the registers 233 and 203 through the input control circuit 10, respectively. This operation is the same as the data input of the display control register 12. The H counter 7 is reset by each vertical synchronizing signal and counts the horizontal synchronizing signal. The coincidence detection circuit 213 compares the display inhibition release data stored in the register 203 and a count value of the H counter 7. When they coincide, the coincidence detection circuit 213 outputs a coincidence signal to the inhibition release signal terminal 22*b* of the display control data output inhibition circuit 22. Since the set-reset flip-flop 221 in the display control data output inhibition circuit 22 outputs "H", the output of the display control circuit 18 is permitted by the AND circuit 222. Output has been inhibited until then, and output is inhibited in the above section Pm. As shown in FIG. 8, since coincidence is detected during the display of a character "A" on the top line, an upper part of the font "A" is not displayed. Thereafter, the H counter counts the horizontal synchronizing signal, and the coincidence detection circuit 243 compares display inhibition start data for the predetermined position Pt stored in the register 233 and a count value of the H counter 7. When they coincide, the coincidence detection circuit 243 outputs a coincidence signal to the inhibition start signal terminal 22*a* of the display control data output inhibition circuit 22. The set-reset flip-flop 221 in the display control data output inhibition circuit 22 thereby outputs "L", and accordingly, the AND circuit 222 inhibits the output of the display control circuit 18, whereby output is inhibited in a lower section Pn. In FIG. 8, since coincidence is detected during the display of a character "C" on the bottom line, a lower part of the font "C" is not displayed.

Therefore, vertical scroll display can be performed with the screen display of this embodiment of the invention in the following way.

At the time when image data CD for displaying an image is set, display inhibition release data for the predetermined position Ph and display inhibition start data for the predetermined position Pt are set in the registers 203 and 233, respectively. Each time an interrupt is generated for each vertical synchronizing signal (VSYNC), the vertical position data of the display control register 12 is replaced with incremented data by the unshown microcomputer. At this time, as described previously, since the display control data output inhibition circuit 22 permits the output of the red, green and blue output signals and the luminance control signal at positions below the predetermined position Ph set in the register 203 and inhibits the output at positions below the predetermined position Pt set in the register 233, displayed characters look as if they are scrolled from the top to the bottom of the screen, and character fonts on the top line and the bottom line come to appear little by little.

Figure 9:
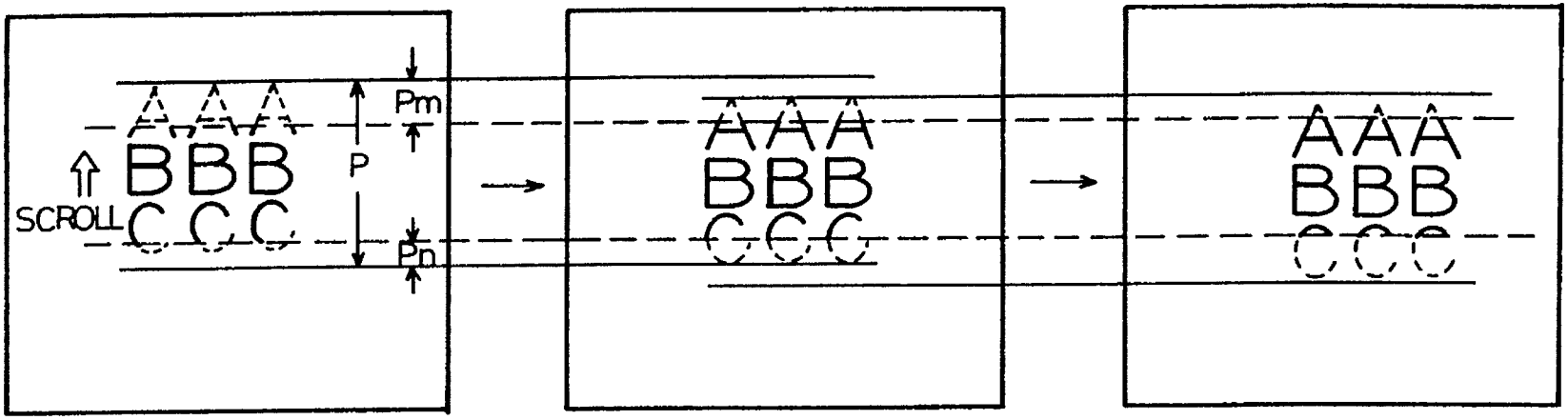
FIG. 9 is a diagram of an example of the vertical scroll display of the embodiment of FIG. 7.

In this way, natural scroll from the top to the bottom of the screen is possible. Natural scroll from the bottom to the top of the screen is also possible by replacing the vertical position data of the display control register 12 with decremented data (refer to FIG. 9).

Figure 10:
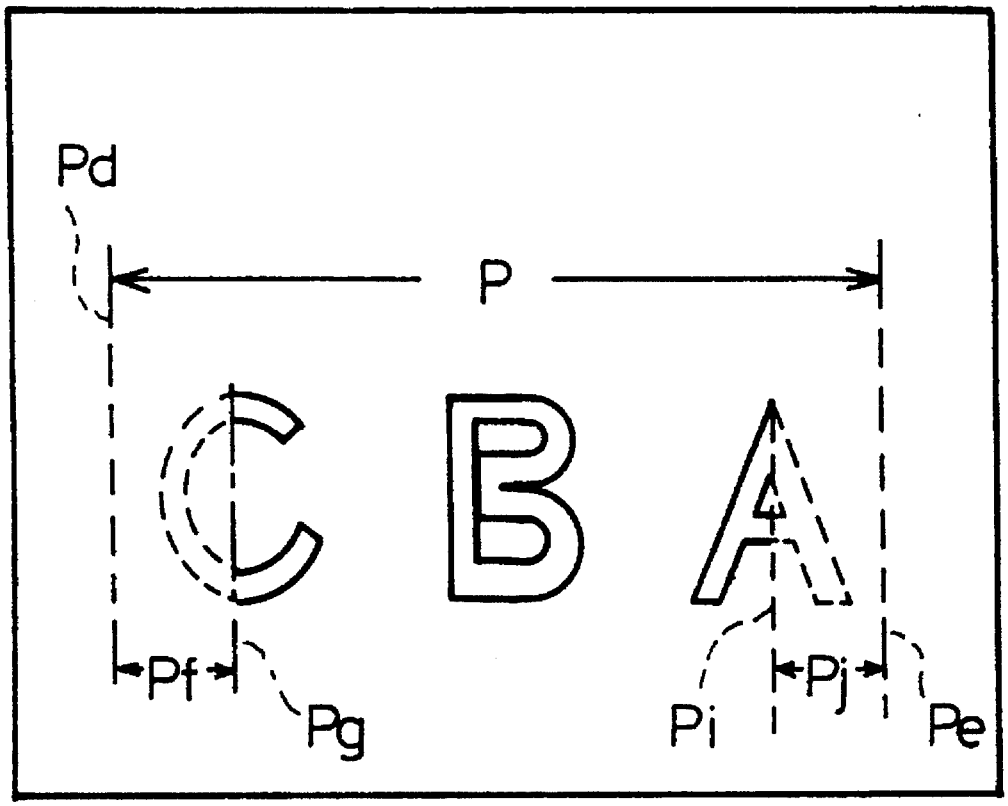
FIG. 10 is a timing chart illustrating the operation of the embodiment of FIG. 7.
Figure 11:
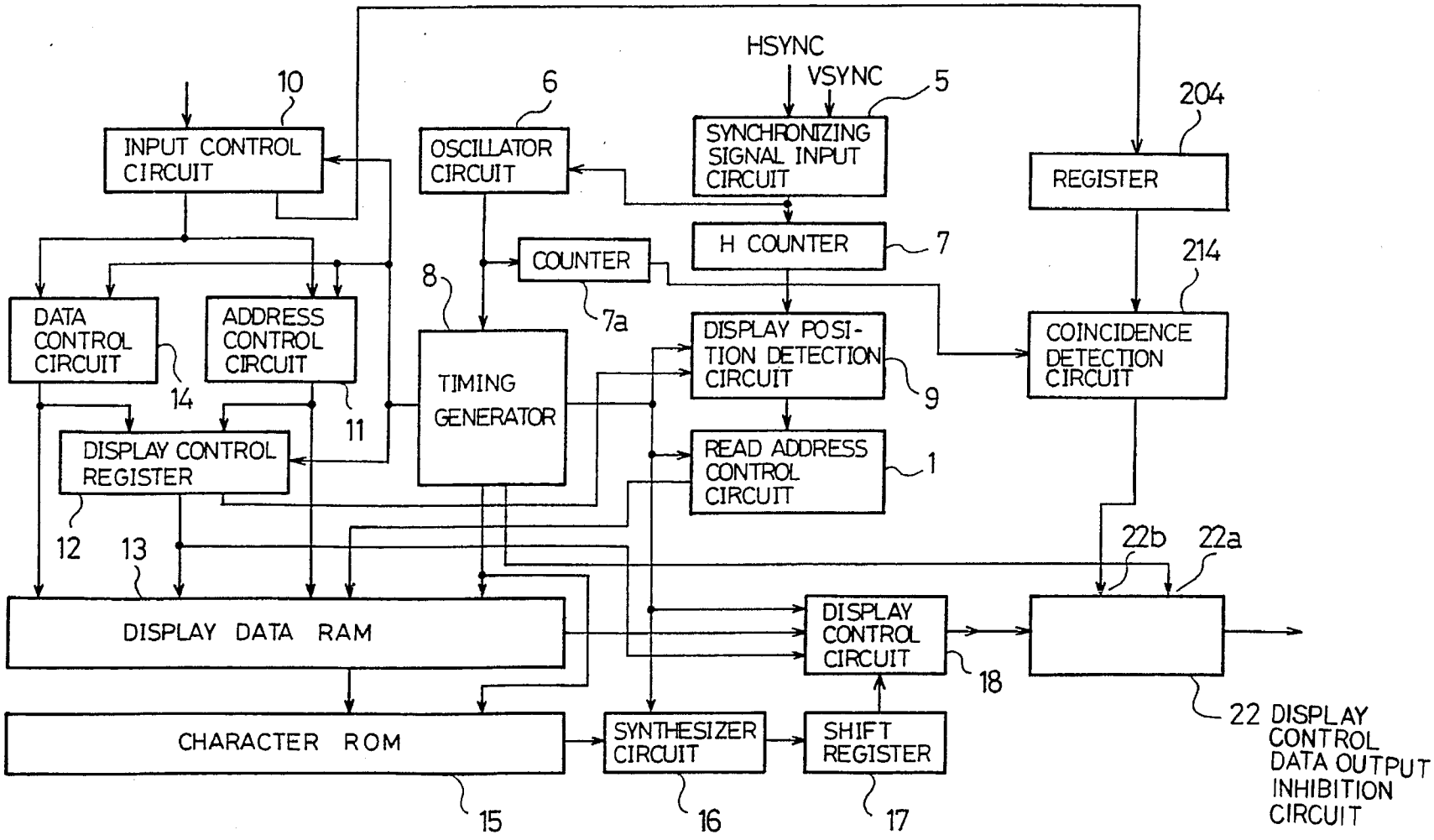
FIG. 11 is a block diagram of another embodiment of the invention.

In the present invention shown in FIG. 10 where display contents N can be scrolled in a horizontal direction (from left to right) of the section P from the left side Pd to the right side Pe, display inhibition start data for the left side Pd (side opposite to the scroll direction) generated from the timing generator 8 is supplied to the inhibition start signal terminal 22*a* of the display control data output inhibition circuit 22, and display inhibition release data for the predetermined position Pg on the right of the left side Pd is stored in the register 204 as shown in FIG. 11. The coincidence detection circuit 214 detects coincidence between the oputput signal of a counter 7*a* for counting an oscillation signal from the oscillator circuit 6 and the output signal of the register 204. When they coincide, the coincidence detection circuit 214 outputs a coincidence signal to the inhibition release signal terminal 22*b* of the display control data output inhibition circuit 22. In this way, the output display control data output inhibition circuit 22 is set at an output inhibition mode in the range of a section Pf.

With this structure, the output of the display contents N in the section Pf on the left side Pd can be inhibited, and the display contents N can be displayed in such a way that they come to appear from a position Pg.

Figure 12:
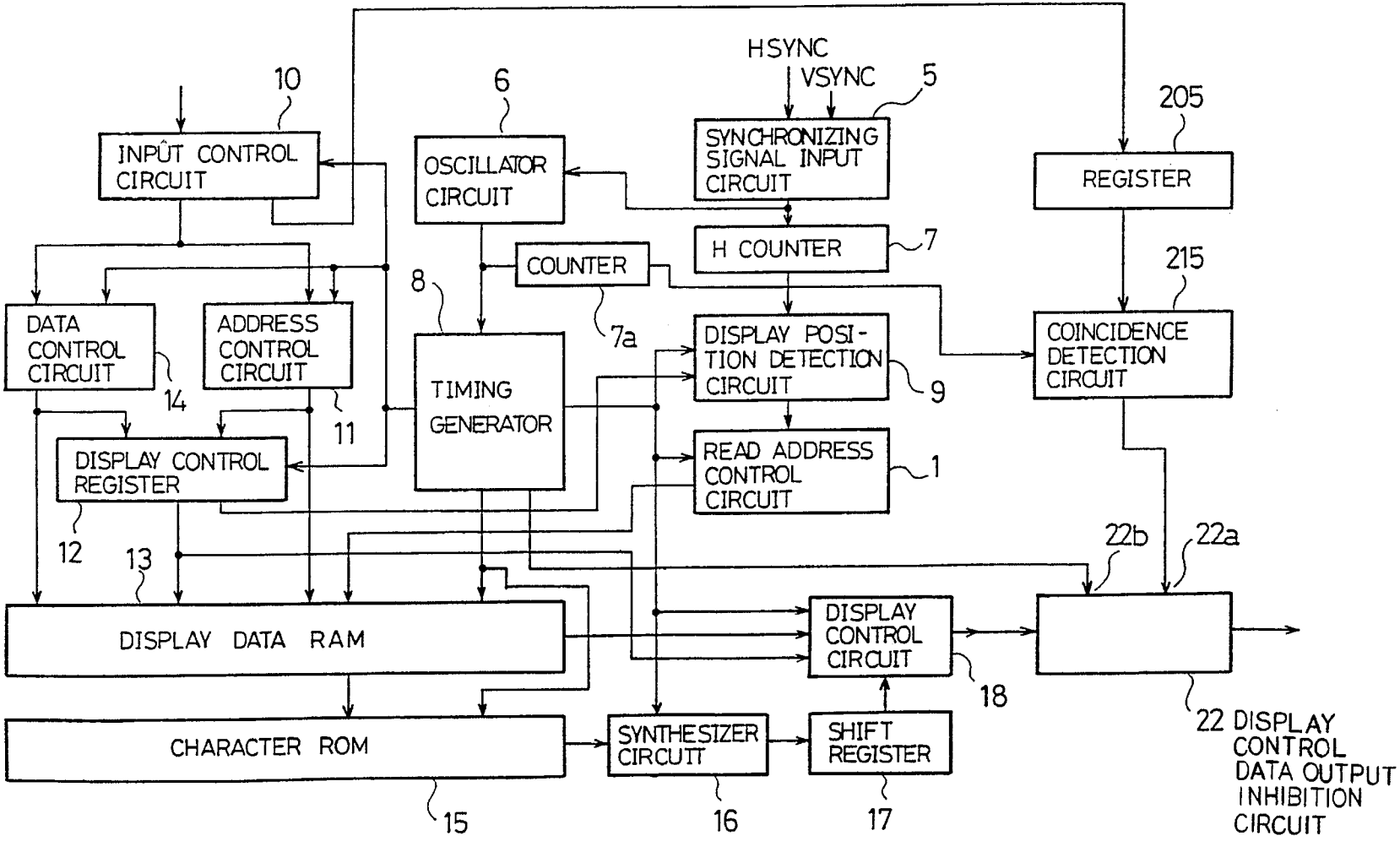
FIG. 12 is a block diagram of another embodiment of the invention.
Figure 13:
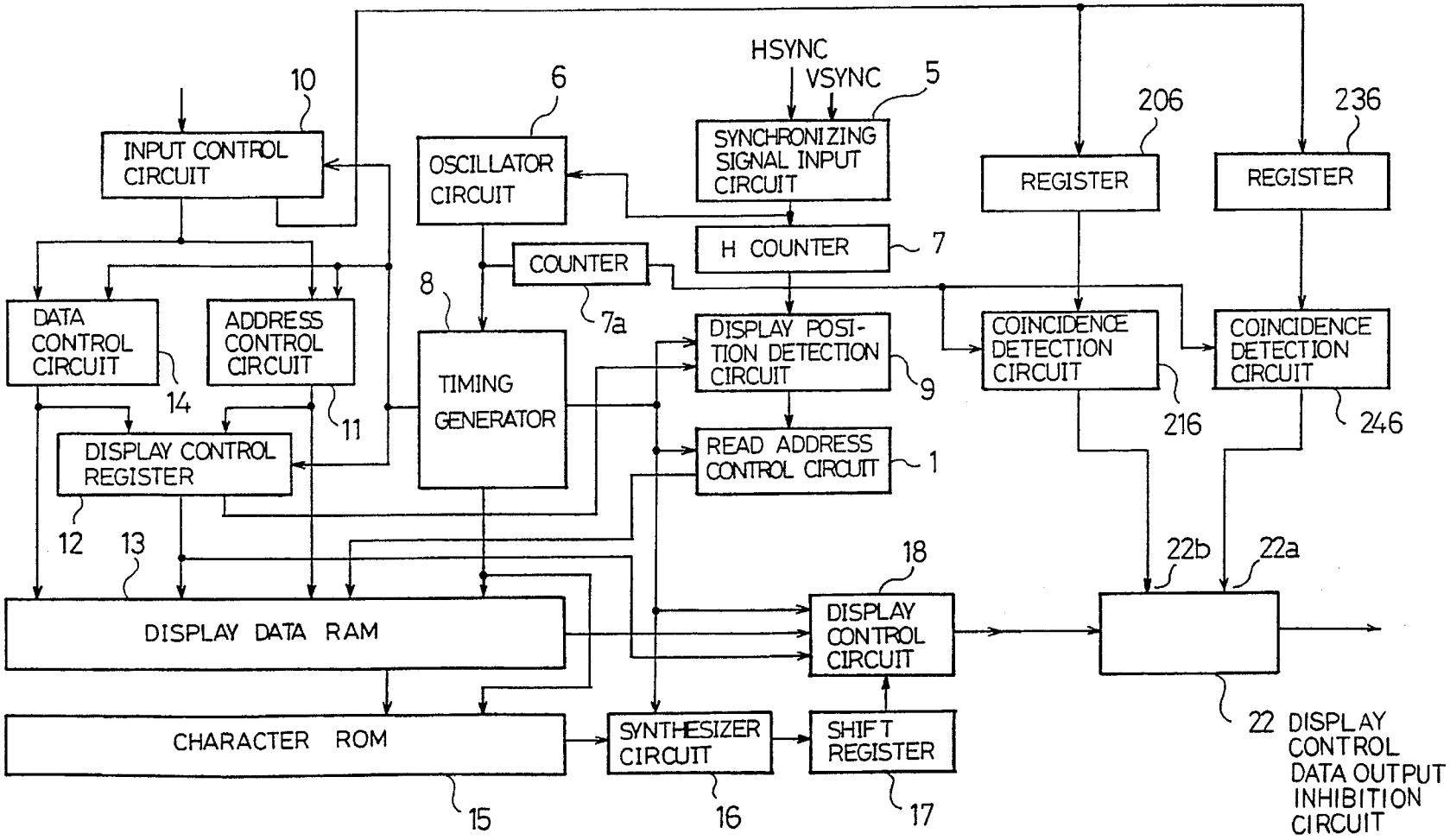
FIG. 13 is a block diagram of another embodiment of the invention.
Figure 14:
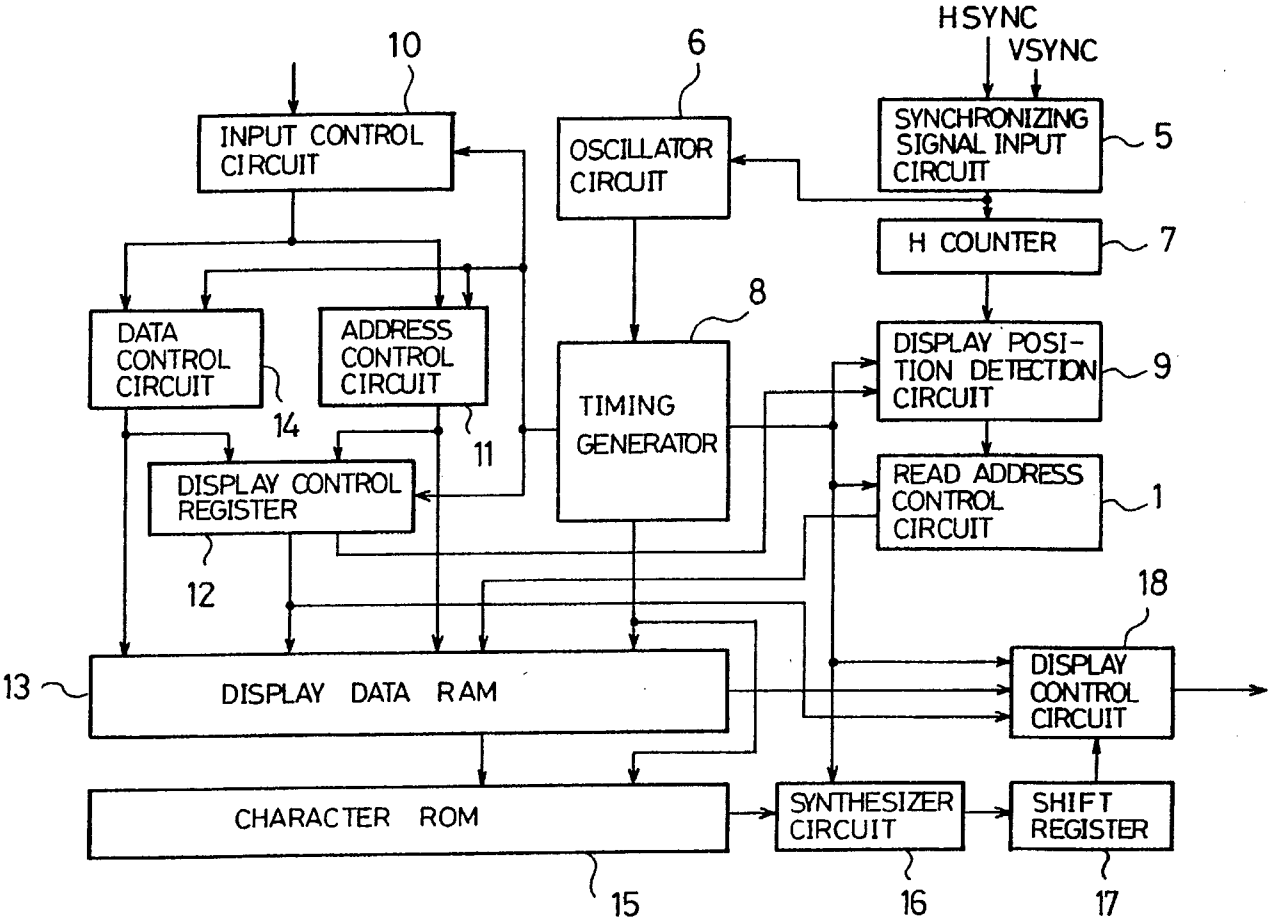
FIG. 14 PRIOR ART
FIG. 14 is a block diagram of the prior art.

In FIG. 10, data for the right side Pe generated from the timing generator 8 is supplied to the inhibition release signal terminal 22*b* of the display control data output inhibition circuit 22 as shown in FIG. 12, and display inhibition start data for a predetermined position Pi is stored in the register 205. The coincidence detection circuit 215 detects coincidence between the output signal of the counter 7*a* for counting an oscillation signal from the oscillator circuit 6 and the output signal of the register 205. When they coincide, the coincidence detection circuit 215 outputs a coincidence signal to the inhibition start signal terminal 22*a* of the display control data output inhibition circuit 22, whereby display output can be inhibited in a section Pj on the right side in the case that horizontal scroll from the right to the left is set. In addition, as shown in FIG. 13, two registers are prepared to store data for the predetermined position Pg in one of the registers and data for the predetermined position Pi in the other so that display output can be inhibited in both sections Pf and Pj.

Downward scroll from the top to the bottom may be set in the circuit of FIG. 1, and upward scroll from the bottom to the top may be set in the circuit of FIG. 4. In this case, a leading part of display contents is controlled in such a way that they disappear in the scroll direction little by little.

In one embodiment of the present invention, output to the display is inhibited in the predetermined sections Pm, Pn, Pf and Pj on the sides Pb, Pa, Pd and Pe by the display control data output inhibition circuit 22, display contents are not displayed in these sections Pm, Pn, Pf and Pj. Therefore, the display contents are displayed in such a way that they come to appear or disappear little by little.

In a second embodiment of the present invention either one of the inhibition start operation and inhibition release operation of the display control data output inhibition circuit 22 is performed based on data for the predetermined positions Pt, Ph, Pg and Pi set in the register in advance, and the other operation is performed based on data for the sides Pb, Pa, Pd and Pe of the scroll section P. Therefore, with a simple circuit configuration, the effect of the invention claimed in claim 1 can be obtained. In addition, since a register is used, the width of a display inhibition section can be easily changed by altering the contents of the register.

In a third embodiment of the present invention, in the case of scroll from the bottom to the top of the screen or from the right to the left of the screen, on one side of the scroll section P opposite to a scroll direction, the inhibition operation of the display control data output inhibition circuit 22 is released according to data generated from the screen display, and performed according to data for a predetermined position away from the above-mentioned side toward the center of the screen. In the case of scroll from the top to the bottom of the screen or from the left to the right of the screen, on one side of the scroll section P opposite to a scroll direction, the inhibition operation of the display control data inhibition circuit 22 is performed according to data generated from the screen display and released according to data for a predetermined position away from the above-mentioned side toward the center of the screen. Therefore, display contents can be displayed in such a way that they come to appear from the predetermined position little by little with a simple structure.

In a fourth embodiment of the present invention the inhibition start and release operations of the display control data inhibition circuit 22 are performed based on data for predetermined positions Pt and Ph set in each register in advance so output to the display is inhibited in predetermined sections Pm and Pn on both sides of the scroll section P by the display control data output inhibition circuit 22. Therefore, one end of display contents appears and the other end disappears little by little on both sides of the scroll section. Furthermore, only two registers are used, and a simple structure can be achieved.

What is claimed is:

1. A control system for displaying characters and symbols comprising a plurality of rows of pixels on a display such as a CRT and for scrolling the characters and symbols over a scroll section having a fixed vertical width and a fixed horizontal width, said control system comprising:

storage means for storing font data for each character line of the characters and symbols;

a display control circuit, coupled to said storage means, for controlling output to the display;

a first register for storing a first predetermined position;

a second register for storing a second predetermined position;

an output signal inhibition circuit, coupled to said first and second registers and to said display control circuit, for starting and releasing inhibition of output to the display according to said first and second predetermined positions so that output to the display of selected rows of pixels of the characters and symbols is inhibited in sections on both sides of the scroll section;

a counter for counting a synchronizing signal;

a first coincidence detection circuit, coupled to said first register and to said counter, for detecting when the count of said counter matches said first predetermined position stored in said first register; and a second coincidence detection circuit, coupled to said second register and to said counter, for detecting when the count of said counter matches said second predetermined position stored in said second register;

wherein said output signal inhibition circuit starts to inhibit output of said selected rows of pixels when said second coincidence detection circuit detects that said count of said counter matches said second predetermined position and stops inhibiting said selected rows of pixels when said first coincidence detection circuit detects that said count of said counter matches said first predetermined position.

2. A control system for displaying characters and symbols comprising a plurality of pixel rows on a display such as a CRT and for scrolling the characters and symbols over a scroll section having a fixed vertical width and a fixed horizontal width, said control system comprising:

storage means for storing font data for each character line of the characters and symbols;

a display control circuit, coupled to said storage means, for controlling output to the display;

a first register for storing a first predetermined position;

a second register for storing a second predetermined position;

an output signal inhibition circuit, coupled to said first and second registers and to said display control circuit, for starting and releasing inhibition of output to the display according to said first and second predetermined positions so that output to the display of selected pixel rows of the characters and symbols is inhibited in sections on both sides of the scroll section;

a first register for storing display inhibition release data;

a second register for storing display inhibition start data;

a counter for counting an oscillation signal from an oscillator circuit;

a first coincidence detection circuit, coupled to said first register and to said counter, for detecting when said count matches said inhibition start data of said first register; and a second coincidence detection circuit, coupled to said second register and to said counter, for detecting when said count matches said inhibition release data of said second register; and wherein said output signal inhibition circuit starts to inhibit the output of said selected pixel rows when said first coincidence detection circuit detects that said count matches said inhibition start data and stops inhibiting said selected pixel rows when said second coincidence detection circuit detects that said count matches said inhibition release data.

* * * * *